US010132286B2

(12) United States Patent
Ikeda et al.

(10) Patent No.: US 10,132,286 B2
(45) Date of Patent: Nov. 20, 2018

(54) IGNITION SYSTEM FOR INTERNAL COMBUSTION ENGINE, AND INTERNAL COMBUSTION ENGINE

(71) Applicant: IMAGINEERING, INC., Kobe-shi, Hyogo (JP)

(72) Inventors: Yuji Ikeda, Kobe (JP); Minoru Makita, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 0 days.

(21) Appl. No.: 14/912,994

(22) PCT Filed: Aug. 21, 2014

(86) PCT No.: PCT/JP2014/071856
§ 371 (c)(1),
(2) Date: May 31, 2016

(87) PCT Pub. No.: WO2015/025913
PCT Pub. Date: Feb. 26, 2015

(65) Prior Publication Data

US 2016/0281670 A1 Sep. 29, 2016

(30) Foreign Application Priority Data

Aug. 21, 2013 (JP) ..... 2013-171781

(51) Int. Cl.
*F02P 3/01* (2006.01)
*H05H 1/46* (2006.01)
(Continued)

(52) U.S. Cl.
CPC ..... *F02P 3/01* (2013.01); *F02P 15/02* (2013.01); *F02P 15/08* (2013.01); *F02P 23/045* (2013.01);
(Continued)

(58) Field of Classification Search
CPC .. F02P 23/045; F02P 9/007; F02P 3/01; F02P 15/02; F02P 15/08; H05H 1/46; H05H 2001/463; H05H 2001/466; F02M 27/04
See application file for complete search history.

(56) References Cited

U.S. PATENT DOCUMENTS

2012/0097140 A1* 4/2012 Kusunoki ..... F02P 9/002 123/620
2013/0119865 A1* 5/2013 Ikeda ..... F02P 3/01 315/111.41
(Continued)

FOREIGN PATENT DOCUMENTS

JP 2010-507206 A 3/2010
JP 2010-096109 A 4/2010
(Continued)

*Primary Examiner* — Sizo Vilakazi
(74) *Attorney, Agent, or Firm* — Westerman, Hattori, Daniels & Adrian, LLP

(57) ABSTRACT

The ignition system has an electromagnetic wave oscillator which oscillates electromagnetic waves, a control device that controls the electromagnetic wave oscillator, a plasma generator which integrates a booster circuit containing a resonant circuit capacitive coupled with the electromagnetic wave oscillator, and a discharge electrode which discharges a high voltage generated by the booster circuit. The plasma generator includes a plurality of discharge electrodes arranged so as to be exposed within the combustion chamber of the internal combustion engine.

10 Claims, 12 Drawing Sheets

(51) Int. Cl.

| | |
|---|---|
| ***F02P 15/02*** | (2006.01) |
| ***F02P 15/08*** | (2006.01) |
| ***F02P 23/04*** | (2006.01) |
| *F02M 27/04* | (2006.01) |

(52) U.S. Cl.
CPC ..... *H05H 1/46* (2013.01); *F02M 27/04* (2013.01); *H05H 2001/463* (2013.01); *H05H 2001/466* (2013.01)

(56) References Cited

U.S. PATENT DOCUMENTS

| | | | | |
|---|---|---|---|---|
| 2014/0202411 | A1* | 7/2014 | Ikeda | F02P 3/01 123/143 B |
| 2014/0352662 | A1* | 12/2014 | Serizawa | F02P 23/045 123/406.27 |
| 2015/0167625 | A1* | 6/2015 | Ikeda | F02P 3/01 315/34 |
| 2015/0322913 | A1* | 11/2015 | Ikeda | F02P 3/01 123/143 B |
| 2015/0340206 | A1* | 11/2015 | Ikeda | H05H 1/46 315/111.41 |
| 2016/0181765 | A1* | 6/2016 | Ikeda | H01T 13/40 315/111.41 |
| 2016/0273509 | A1* | 9/2016 | Ikeda | H01T 13/20 |

FOREIGN PATENT DOCUMENTS

| | | | | |
|---|---|---|---|---|
| JP | 2011-150830 | A | 8/2011 | |
| WO | WO 2014115707 | A1 * | 7/2014 | F02P 3/01 |

* cited by examiner

IGNITION SYSTEM FOR INTERNAL COMBUSTION ENGINE, AND INTERNAL COMBUSTION ENGINE

TECHNICAL FIELD

The present invention relates to an ignition device for an internal combustion engine and an internal combustion engine comprising the ignition device.

BACKGROUND

An ignition device that uses a plasma generation device which radiates an EM (electromagnetic) radiation to the inside of a combustion chamber of an internal combustion engine for generating EM wave plasma is proposed as an ignition device for igniting the internal combustion engine. This kind of ignition device for igniting the internal combustion engine using the plasma generation device is described in JP 2009-38025A1 or JP 2006-132518A1, for example.

In JP 2009-38025A1, a plasma generation device that generates spark discharge in a discharge gap of the spark plug and that radiates microwaves to the discharge gap for enlarging plasma is described. In this plasma generation device, the plasma generated by the spark discharge receives energy from the microwave pulse. The electron in the plasma area is thereby accelerated and the ionizing is promoted to increase the volume of the plasma.

In JP 2006-132518 A1, an ignition device for an internal combustion engine that generates a plasma discharge by radiating EM wave from EM wave device to the combustion chamber is described. An ignition electrode is installed on the upper surface of the piston and is isolated electrically from the piston so that the ignition electrode increases the local EM field intensity in its neighborhood in the combustion chamber. In the ignition device of internal combustion engine, plasma discharge is thereby generated near the ignition electrode.

PRIOR ART DOCUMENTS

Patent Document

Patent Document 1: JP 2009-38025 A1
Patent Document 2: JP 2006-132518 A1

SUMMARY OF INVENTION

Problems to be Solved

However, according to the plasma generation device described in JP 2009-38025A1, at least two power supplies are necessary, i.e., one high voltage power source for generating discharge in the spark plug, and one high frequency power source for radiating the microwave. For example, if the plasma generation device is utilized for combustion chambers of automobile engines, the space is very limited. Thus, it is difficult to secure the installation place for such multi-power supplied plasma generation device. Further, in addition to the high voltage transmission system conventional spark plug, the EM wave transmission system is also required as the transmission system which complicates the system. However, since it is difficult to generate plasma only by EM waves, it is necessary to equip the spark plug for creating a fire seed. The plasma generation device described in JP 2006-132518 A1 requires only a single power source because the plasma is created using EM wave only. However, a large amount of electric power should be supplied from the high frequency power source to realize the ignition and combustion reaction solely by EM wave.

The present invention is in view of this respect. The objective of the present invention is to provide an ignition device of an internal combustion engine, specifically to provide a small sized ignition device for internal combustion engine which does not require a spark plug that discharges using high voltage or other complicated system, and to provide the ignition device capable of generating, expanding and maintaining the plasma using only the EM wave and an internal combustion engine comprising thereof.

Measures for Carrying Out the Invention

The first invention relates to an ignition device of the internal combustion engine comprising: an EM oscillator that oscillates EM wave; a control device that controls the EM wave oscillator; and a plasma generator including an amplifying circuit that is capacity coupled with the EM wave oscillator and a discharge electrode that discharges the high voltage generated by the amplifying circuit, wherein the amplifying circuit and the discharge electrode are formed integrally. A plurality of the plasma generator is installed so that the discharge electrode exposes to the combustion chamber of the internal combustion engine.

The ignition device of present invention needs only one power source because the plasma can be generated, expanded and maintained only by EM wave. The plasma generator can generate a high voltage by using the amplifying circuit that resonates with the EM wave. This can generate the spark efficiently to generate plasma even when only the EM wave is used. Further, the EM wave used in the ignition device of present invention has fairly high frequency, which downsizes the resonant circuit of the plasma generator, and the diameter of the portion attached to the cylinder head can thereby be made small compared to the conventional spark plug. This allows an easy installation multiple plasma generators without changing the structure or size of inlet or outlet valves or geometry of the cylinder head.

It is preferable to install the plasma generators on the center of combustion chamber ceiling of the internal combustion engine, the portion between inlet ports, between the outlet ports, or between the inlet and outlet port of the combustion chamber ceiling. By installing the plasma generator as such, the plasma originated by EM wave can be maintained and expanded efficiently. The combustion chamber ceiling refers to a surface of the cylinder head that is exposed to the combustion chamber and may include a surface that is parallel to the piston as well.

The plasma generators may be installed along the outer circumference of the combustion chamber ceiling. By installing the plasma generators as such, a fire seed, i.e. plasma originated by the EM waves, is transmitted from the outer circumference of the cylinder toward the center of the cylinder. In the internal combustion engine that equips a spark plug at the center of the cylinder head, the flame transmits from the center to the outer circumferences. In such case, there is a drawback in heat efficiency because the heat is transmitted to the cylinder wall at the outer circumferences, where the temperature becomes the highest. However, according this structure, where the flame propagates from the outer circumferences of the cylinder toward the center, there is an advantage in respect of heat efficiency.

The control device may control so that the EM waves are supplied to each plasma generators in different time. By controlling the EM wave based plasma generation using time difference, the flame propagation or flame position in the combustion chamber can be controlled.

The control device may control the oscillation of the EM oscillator so that the discharge from each discharge electrodes depicts a circle or semicircle. This allows generating an EM wave based plasma along the swirl flow from the intake valve.

The multiple resonant circuits can be configured such that each generator resonates in the different frequency characteristics. The controller may control the oscillation of the EM oscillator by specifying the resonance frequency for each resonant circuit. The generation position of the EM wave based plasma can be controlled by just controlling the frequency of the oscillating EM waves.

The second invention for solving the above mentioned problem relates to an ignition device of the internal combustion engine comprising: an EM oscillator that oscillates EM wave; a control device that controls the EM wave oscillator; a plasma generator including an amplifying circuit that is capacity coupled with the EM wave oscillator and a discharge electrode that discharges the high voltage generated by the amplifying circuit, wherein the amplifying circuit and the discharge electrode are formed integrally; and an EM wave radiation antenna that radiates an EM wave that assists the EM wave plasma generated by the plasma generator. The plasma generator is installed such that the discharge electrode exposes to the combustion chamber; and at least one EM wave radiation antenna is installed in the position so that the EM wave plasma generated by the plasma generator can be moved away from the plasma generator.

Similarly to the first invention, the ignition device according to the present invention can generate, expand and maintain the plasma by using EM wave only. Thus, it requires only one power supply. Further, the plasma generator can generate a high voltage by equipping an amplifying circuit for resonation of the EM wave, and can efficiently generate spark by using EM wave only. Further, according to the ignition device of the invention, the combustion efficiency of the internal combustion engine can be improved by using at least one plasma generator for occurring spark discharge and the EM wave radiation antenna for expanding and maintaining the plasma generated by the plasma generator and for moving the generated plasma to the other directions inside the cylinder.

In this case, the EM wave can be supplied to the EM wave radiation antenna using the reflection wave from the plasma generator. When the discharge occurs as a result of the high voltage created by the amplification of the amplifying circuit, the impedance between the EM wave oscillator and the plasma generator does not match and the reflection wave is thereby caused. The use of this reflection wave allows downsizing of the EM wave oscillator.

In this case, it is preferable that the EM wave oscillator, the plasma generator, and the EM wave radiation antenna are connected to connection terminals of a circulator such that a progressive wave from the EM wave oscillator flows to the plasma generator and a reflection wave from the plasma generator flows to EM wave radiation antenna. Use of the circulator allows utilizing the reflected wave effectively with a simple circuit.

The present invention can be used for an internal combustion engine that comprises the above ignition device and an internal combustion engine forming combustion chamber therein.

The internal combustion engine of the present invention equips the above mentioned ignition device that can generate, maintain and expand plasma efficiently only by EM radiation, and thus has good combustion efficiency.

Advantage of the Invention

The plasma generator of the present invention can generate high voltage by including the amplifying circuit that resonates with the EM wave, and can cause spark only by the EM radiation. Thus, the plasma generator needs only single power source and does not require complex transmission lines. The plasma generator uses a predetermined oscillation pattern that includes an EM wave pulse that meets condition for causing the spark discharge and EM wave pulse that meets condition for generating discharge for expanding and maintaining the generated plasma. Therefore, plasma generation, expansion, and maintenance can be done efficiently only by use of EM wave and can reduce power consumption and improves the combustion efficiency.

BRIEF DESCRIPTION OF THE DRAWINGS

FIG. 3 illustrates different examples of discharge electrode of plasma generator.

DESCRIPTION OF THE PREFERRED EMBODIMENTS

The embodiments of the present invention are detailed with reference to the accompanying drawings. The embodiments below are the preferred embodiments of the invention, but are not intended to limit the scope of present invention and application or usage thereof.

First Embodiment

Ignition Device for Internal Combustion Engine

Figure 1:
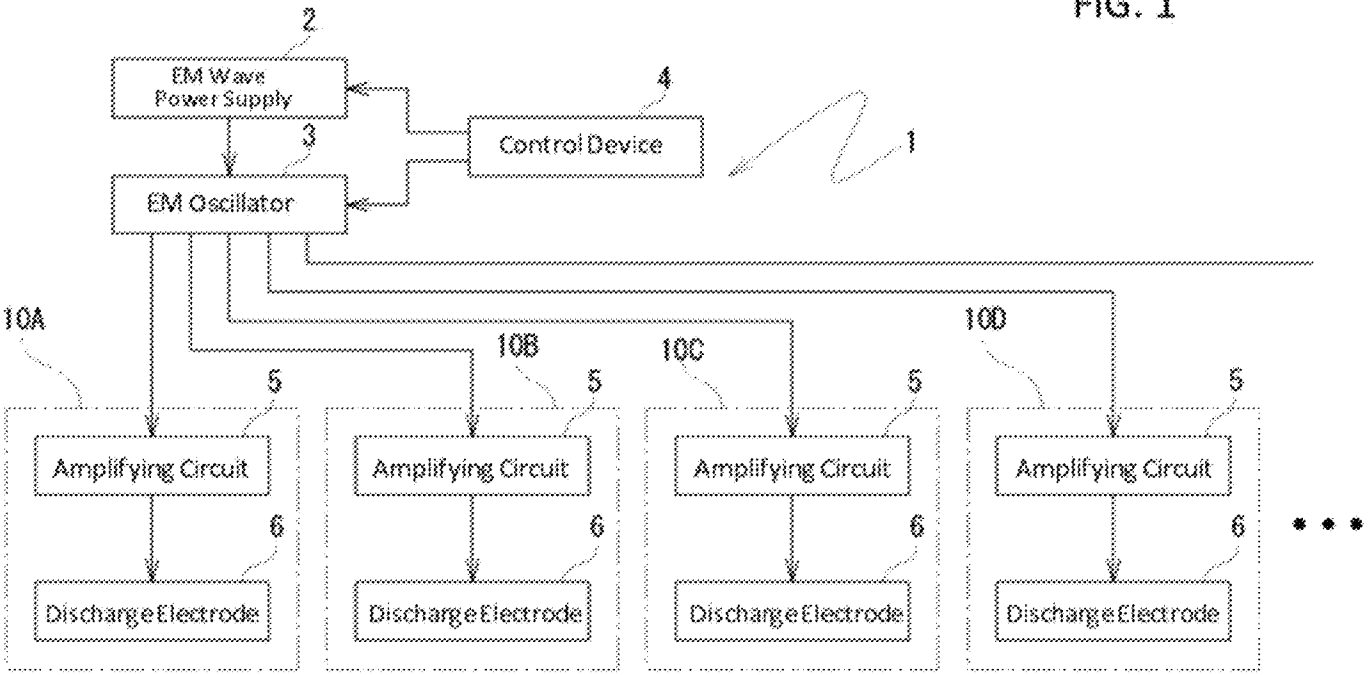
FIG. 1 is a block diagram of the ignition device of the internal combustion engine according to the first embodiment.

The present embodiment relates to an example of an ignition device for internal combustion engine of the present invention. As illustrated in FIG. 1, ignition device 1 includes EM wave power supply 2, EM wave oscillator 3, amplifying circuit 5, discharge electrode 6, and controller 4. Amplifying circuit 5 and discharge electrode 6 are formed integrally to compose plasma generator 10. The resonant circuit included in amplifying circuit 5 comprises a first resonance part Re1 and a second resonance part Re2 which will be described later.

EM wave power supply 2 outputs a pulse current to EM wave oscillator 3 with a pattern including a predetermined duty ratio and a pulse time upon receiving an EM wave oscillation signal such as TTL signal from controller 4.

EM wave oscillator 3 is a semiconductor oscillator, for example. EM wave oscillator 3 is connected electrically with EM wave power supply 2. When the pulse current is received from EM wave power supply 2, EM wave oscillator 3 outputs microwave pulses to amplifying circuit 5. Use of semiconductor oscillator allows an easy control and changes of output, frequency, phase, duty ratio and pulse time of the irradiating EM wave, and specifying the plasma generator 10 which is to be oscillated. In this embodiment, EM wave oscillator 3 builds in a distribution function such as switches for specifying the oscillating plasma generator 10. EM wave oscillator 3 builds in an amplifier such as the power amplifiers. This amplifier oscillates EM waves from EM wave oscillator 3 to plasma generator 10 when ON/OFF instructions are received from controller 4.

Plasma generator 10 integrally forms amplifying circuit 5 and discharge electrode 6. Amplifying circuit 5 includes an input part center electrode 53, an output part center electrode 55, a connection part electrode 54 and an insulator 59 (a dielectric substance). The electrodes 53, 55 and 54, and insulator 59 are accommodated coaxially. But the structure is not limited to this kind. Center electrode 53 in the input part is connected from EM wave oscillator 3 through input part 52, and set up in case 51 with plasma generator 10. Center electrode 53 is capacity coupled with the connection part electrode 54 through insulator 59.

Connection part electrode 54 is shaped cylindrical and has a bottom portion. The inner diameter of the cylindrical part of the electrode 54, the outer diameter of center electrode 53, and the connecting strength, i.e., distance L1 between the front tip portion of center electrode 53 and the cylindrical part of electrode 54 determines the connecting capacity C1. Center electrode 53 is installed movable in the shaft center direction so that connecting capacity C1 can be adjusted. For example, adjustment can be made using screw. Connecting capacity C1 can be also adjusted easily by cutting diagonally the opening edge portion of the electrode 54.

Resonance capacity C2 is the earth capacity, i.e., floating capacity originated from the first resonance portion Re1 of the resonant circuit formed by the connection part electrode 54 and case 51. Resonance capacity C2 is determined by cylindrical length and outer diameter of the electrode 54, inner diameter of case 51 (specifically, the inner diameter of the portion that covers electrode 54), space between the electrode 54 and case 51 (specifically the space that covers the electrode 54) and dielectric constant of insulator (dielectric substance) 59. The resonance frequency of the first resonance portion Re1 is designed so that it resonates with the EM wave, e.g., microwave oscillated from EM wave oscillator 3.

Resonance capacity C3 is discharge side capacity (floating capacity) originated from resonant circuit Re2 that is formed by an output part center electrode 55 and a portion of case 51 that covers resonance portion Re1 of the resonant circuit. Center electrode 55 has axial part 55*b* that is stretched from bottom center of the electrode 54 and discharge part 55*a* that is formed at the tip point of axis 55*b*. Discharge part 55*a* has a large diameter compared to axial part 55*b*. Resonance capacity C3 is determined by length and outer diameters of discharge part 55*a* and axial part 55*b*, inner diameter of case 51 (specifically, the inner diameter of the portion that covers center electrode 55), space between center electrode 55 and case 51 (specifically, the front tip portion 51*a* of case 51 that covers center electrode 55) are determined based on dielectric constant of insulator (dielectric substance).

Figure 2:
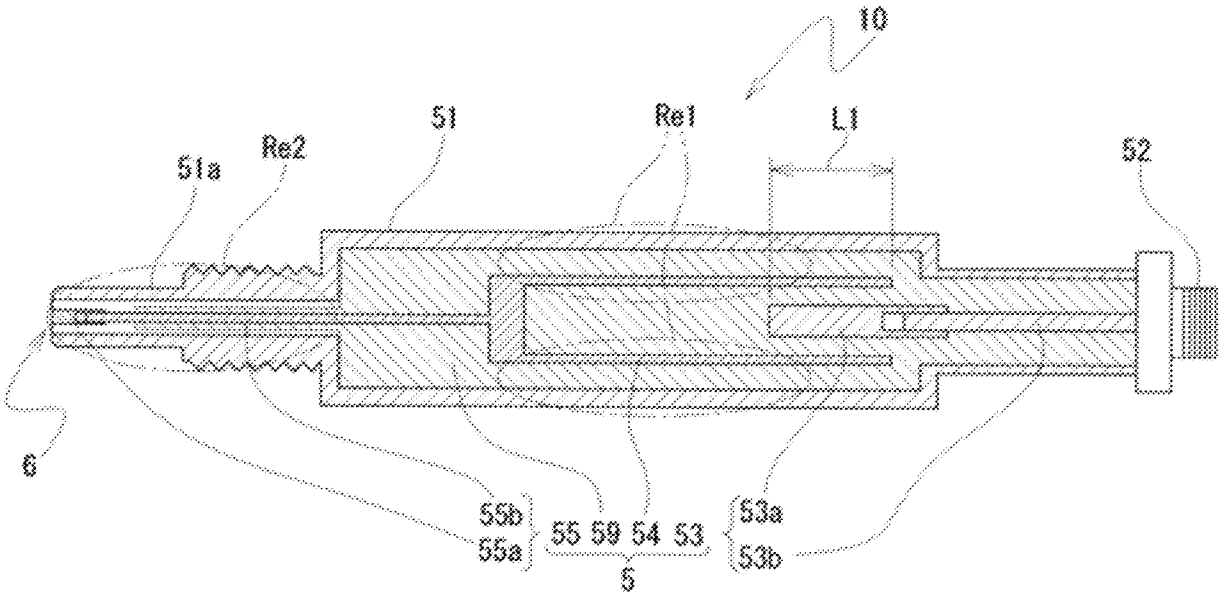
FIG. 2 is a cross sectional view of the plasma generator that is used in the ignition device.

Discharge part 55*a* is arranged movable in the axis direction in respect to axial part 55*b*. Discharge part 55*a* controls resonance capacity C3 by preparing several kinds having different outer diameter. Specifically, male screw part is formed at the tip of axial part 55*b* and female screw part corresponding to male screw part of axial part 55*b* is formed in the bottom of discharge part 55*a*. The circumference of discharge part 55*a* can be made spherical so that the distance can be made different in the axial direction between the inner surface of tip part 51*a* of case 51 and discharge part 55*a*. For this purpose, the geometry of discharge part 55*a* can be made spherical, semi-spherical, or spheroid shape. The inner surface of tip part 51*a* of case 51 (corresponds to earth electrode) and discharge part 55*a* constitutes discharge electrode 6, and discharge occurs at the gap between the inner surface of tip part 51*a* of case 51 (earth electrode) and discharge part 55*a*. As shown in FIG. 2, the edge portion of insulator 59 covering axial part 55*b* has the length so as not to reach discharge part 55*a*. The discharge at discharge electrode 6 thereby becomes a spatial discharge.

Figure 3A:
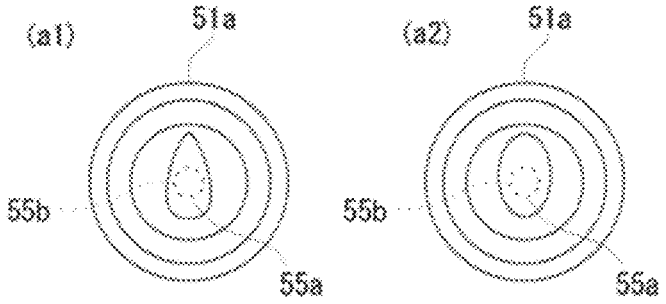
FIG. 3A shows an example of the electrode having a partially narrowed discharge gap.

Discharge part 55*a* constituting discharge electrode 6 has teardrop or elliptical shape as shown in FIG. 3A to ensure the discharge. Discharge part 55*a* can be attached eccentrically to axial part 55*b*. The discharge thereby occurs stably between the inner circumference side of tip part 51*a*, and the sharp head portion of discharge part 55*a*. The distance between the inner surface of tip part 51*a* and outer surface of discharge part 55*a*, and the area of an annular portion, formed of a gap between the inner surface of tip part 51*a* and outer surface of discharge part 55*a*, are important factor for determining the resonance frequency in this type of geometry also. Therefore, the distance between the inner surface of tip part 51*a* and outer surface of discharge part 55*a*, and the area of an annular portion shall be calculated in detail.

The partially short discharge gap thus allows a discharge in low electrical power under high pressure. According to an experiment done by the inventors, a discharge was seen under 15 Barr by applying only 500 W when the partially short discharge gap was employed, while the discharge was not seen even if 1 kW was applied when discharge part 55*a* is cylindrical and coaxial with case 51 (in this type, discharge was seen under 8 Barr with 840 W applied).

Tip part 51*a* of case 51 has a screw thread (male screw part) formed in the outer surface so that it can be screwed to an attachment portion formed in the cylinder head of the internal-combustion engine described later. The male screw part can be formed on entire tip portion 51*a* but can be formed only at the root portion. The diameter of the discharge electrode 6 portions can thereby be made smaller than the screw thread portion and this allows a multiple arrangement in the cylinder head of the internal-combustion engine.

EM wave oscillator 3 can oscillate EM wave simultaneously to multiple plasma generator 10; however, oscillation signal is transmitted to each plasma generator 10 by different timings from control device 4 in this embodiment. This downsizes the capacity of EM wave power supply 2.

Figure 4:
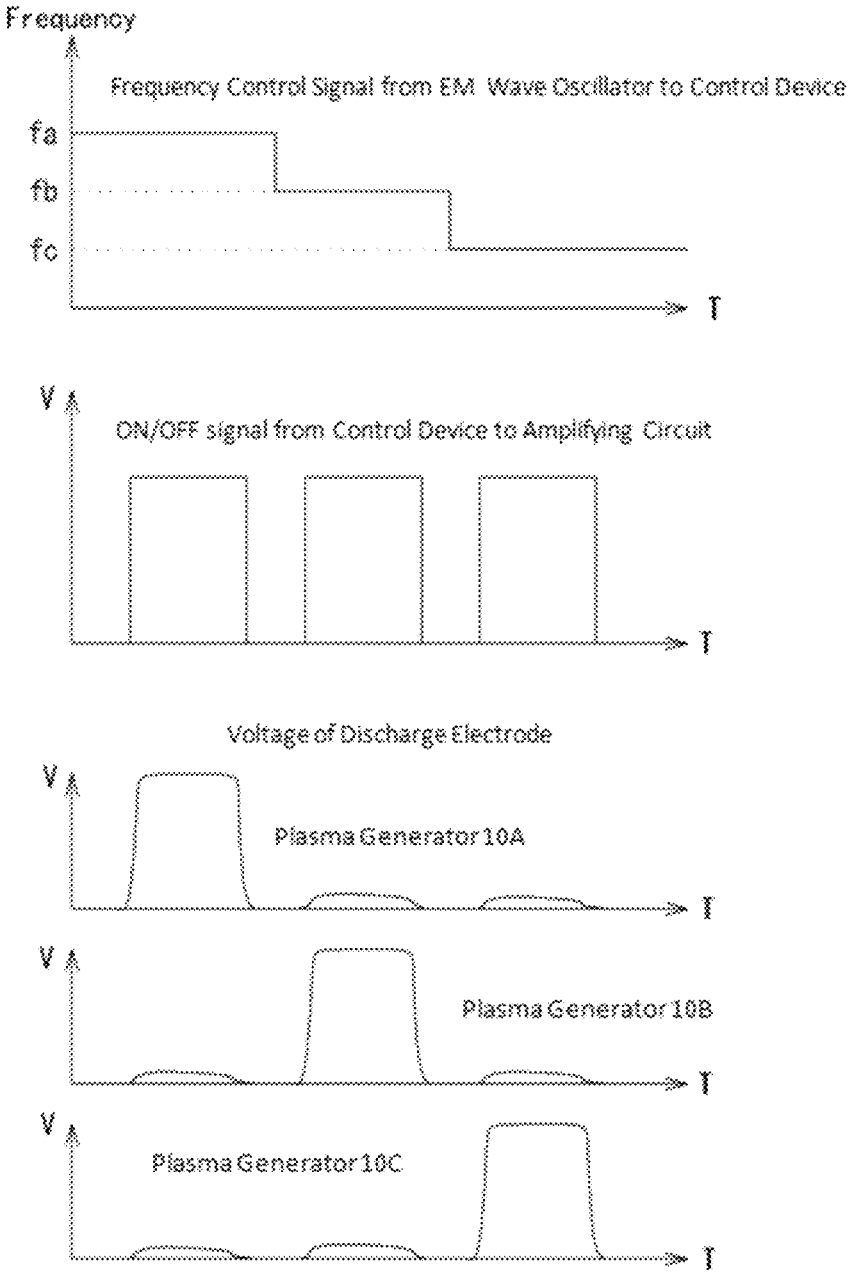
FIG. 4 illustrates a method for selecting a plasma generator which is to be discharged. In this example, the frequencies of the resonant circuits included in the amplifying circuits are set differently.
Figure 5:
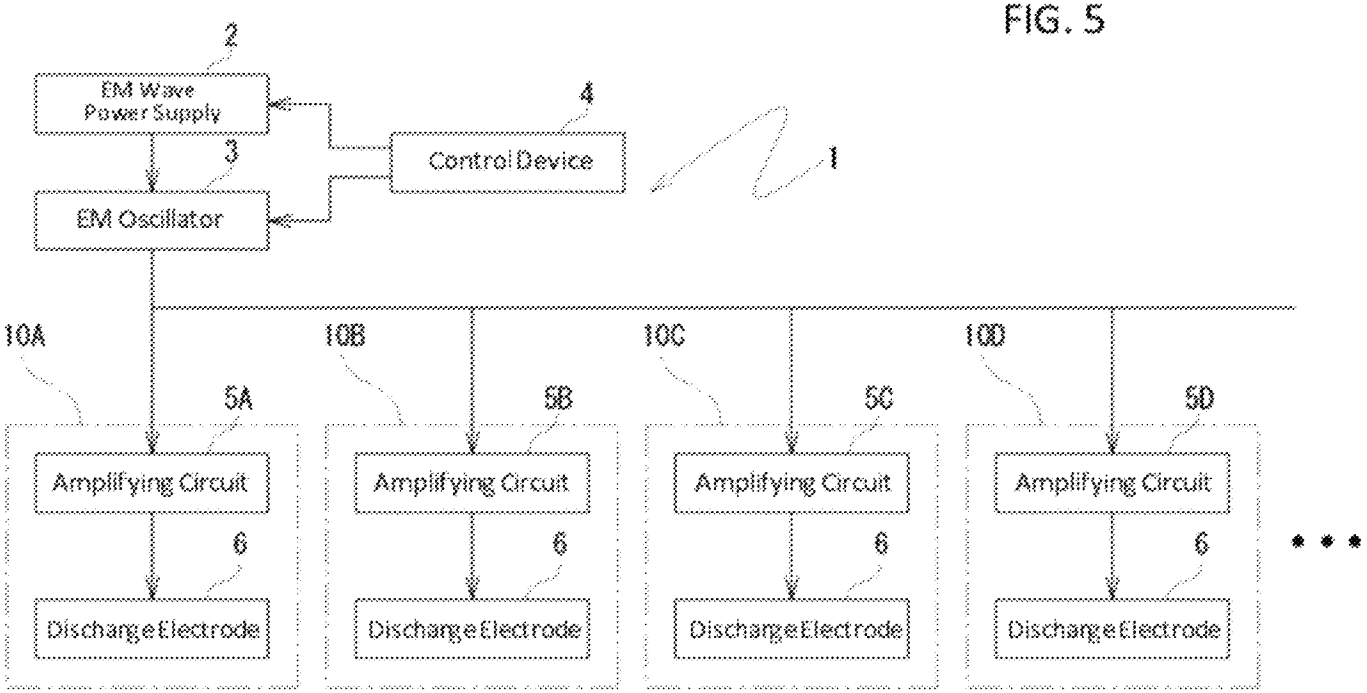
FIG. 5 is a block diagram of another ignition device of the internal combustion engine according to the first embodiment.

To make each discharge electrodes 6 discharge by oscillating the EM wave using the oscillation signal from control device 4 with different timing, a distribution means made of switching circuits can be arranged inside EM-wave oscillator 3 as described above and can be controlled from control device 4. Multiple plasma generators 10 can be configured so that each resonates with different frequency characteristic as shown in FIGS. 4 and 5, and control device 4 can specify the resonant frequency of each resonant circuit to control the oscillation control of the EM-wave oscillator. For example, as shown in FIG. 4, resonance frequencies of amplifying circuits 5A, 5B, 5C, and 5D (which includes the resonant circuits of plasma generators 10A, 10B, 10C, and 10D respectively) can be set to fa, fb, fc, and fd respectively. To make the amplified EM waves from discharge electrode 6 of plasma generator 10A, control device 4 controls the frequency of EM waves oscillated from EM wave oscillator 3 to fa. The settings of resonance frequencies fa, fb, fc, and fd, specifically the intervals between each frequencies is determined based on Q factor which can be defined by the structure of the resonant circuit. The Q value can be expressed as $$w0/(w2-w1)$$

where w1 and w2 stand for frequencies where the energy becomes the half of resonance frequency w0, and w1<w2. In this embodiment, Q factor is set approximately between 81 and 122.5 (w2−w1 is 20 to 30 MHz) when w0 is 2.45 GHz. When Q factor is in this range, w1 is between 2.460 and 2.465 GHz, and w2 is between 2.435 and 2.440 GHz, when the resonance frequency w0 is 2.45 GHz. The interval of the frequency shall therefore be approximately 0.05 GHz. For instance, fa, fb, and fc can be selected as 2.40, 2.45, and 2.50 GHz respectively when three frequencies are set around 2.45 GHz.

FIG. 4 is a graph indicating the discharge voltage from discharge electrode 6 of plasma generators 10A, 10B, and 10C, when EM-wave oscillator 3, under the control of control device 4, outputs the signal for switching the frequency of EM waves to fa, fb, and fc; and ON/OFF signal to amplifier. The discharging plasma generator 10 can be selected by configuring a resonant circuit of high Q factor, without constituting the large difference between each frequency fa, fb, and fc.

Figure 6:
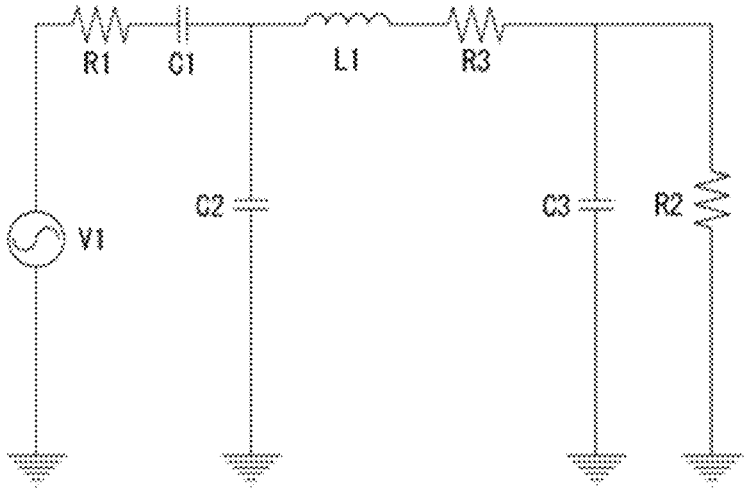
FIG. 6 is a cross sectional view of the plasma generator that is used in the ignition device.

FIG. 6 illustrates an equivalent circuit of amplifying circuit 5. Amplifying circuit 5 includes a resonant circuit comprising capacitors C2 capacitive coupled b EM-wave oscillator 3 and capacitor C3 made of discharge electrode portion.

Operation of the Ignition Device

The plasma generation operation of ignition device 1 will be discussed. Plasma is generated in the neighbor of discharge electrode 6 by discharge from discharge electrode 6 in the plasma generation operation.

According to an example of plasma generation operation, control device 4 first outputs the EM wave oscillation signal of predetermined frequency fa. EM wave power supply 2 outputs a pulsed current for predetermined period with predetermined duty ratio when such an EM-wave oscillation signal is received from control device 4. EM-wave oscillator 3 outputs the EM-wave pulse of frequency fa by predetermined duty ratio for the set period. EM-wave pulse output from EM-wave oscillator 3 becomes high voltage by amplifying circuit 5 of plasma generator 10A of resonance frequency fa. The high voltage can be made because the floating capacity between center electrode 55 and case 51, and the floating capacity between coupling part electrode 54 and case 51 resonates with a coil (corresponding to axial part 55*b*). Discharge occurs from discharge part 55*a* toward the inner side (earth electrode) of tip part 51*a* of case 51, and a spark then arises. This spark allows electrons to emit from gas molecules near discharge electrode 6 of plasma generator 10A, and plasma is thereby generated.

Control device 4 subsequently outputs the EM-wave oscillation signal of predetermined frequency fb. In the manner similar to the above, amplifying circuit 5 in plasma generator 10B of resonance frequency fb creates high voltage and a spark thereby arises. Electrons are emitted due to this spark from gas molecules near discharge electrode 6 of plasma generator 10B, and plasma is generated. The frequency of the outputted EM-wave oscillation signal is varied to generate the plasma from each plasma generator 10. The selection of plasma generators 10, which generate plasma, can be done by various ways such as arranging the switching device inside the EM-wave oscillator 3, and is not restricted to the frequency control using the frequency of resonant circuit.

Advantage of the First Embodiment

Plasma generator 10 of ignition device 1 according the first embodiment can generate high voltage by employing amplifying circuit 5 including a resonant circuit made of first resonance part Re1 and second resonance part Re2 which resonate EM waves, which allows causing a spark only by EM waves. Therefore, plasma can be generated, maintained and enlarged from multiple plasma generators 10 by using EM waves only. One EM wave power supply 2 is enough for the power supplies and a complicated transmission lines are not necessary. Further, discharging order and intensity can be set easily using control device from the multiple plasma generators 10. Direction of a flame, which is determined by tumble, turbulence, and valve timing; control of flame propagation, and igniting order in different locations can be controlled conveniently. Temperature inside the combustion chamber can be controlled conveniently by controlling the output of EM waves. Further, diameter of the tip of plasma generator 10 can be made thinner because each electrode constituting amplifying circuit 5 of the output unit is accommodated coaxially inside the case 51.

Knocking in an internal combustion engine can be prevented efficiently by controlling the igniting location of a flame by employing plasma generator 10 of ignition device 1. In this case, the knocking can be reduced stably by using knock sensor also and by an ignition control according to the knocking locations.

Modification 1 of the First Embodiment

In Modification 1 of the first embodiment, plasma generator 10 is similar to the first embodiment; except that the plasma generator 10 differs in the structure of discharge electrode 6.

Figure 3B:
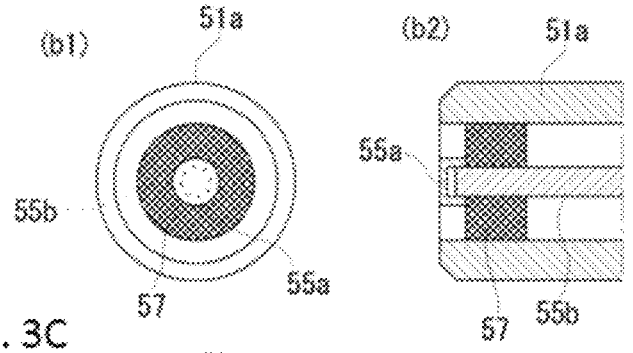
FIG. 3B shows an example of the electrode having a dielectric substance installed between the electrodes for causing a creeping discharge.
Figure 3C:
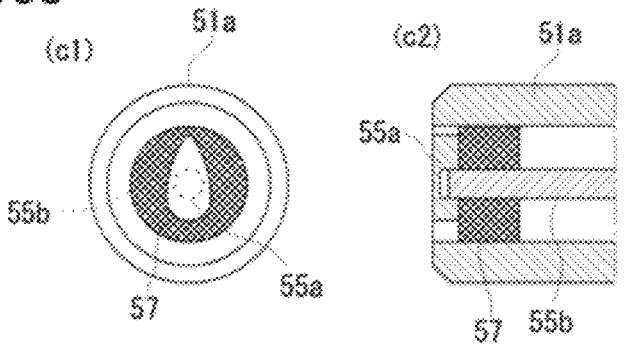
FIG. 3C shows an example of the electrode that can cause a creeping discharge and having a partially narrowed discharge gap.

Discharge electrode 6 is configured so that a surface discharge occurs between discharge part 55*a* and the inner surface of tip part 51*a* (earth electrode) of case 51. Surface discharge can reduce a voltage necessary for the discharge by disposing a dielectric substance between the electrodes and by making discharge along the dielectric substance. As shown in FIG. 3B, for instance, an annular dielectric substance 57 is attached to axial part 55*b* so as to contact the inner surface of tip part 51*a*. Discharge part 55*a* is attached to axial part 55*b* so as to contact the surface of dielectric 57.

In this case, discharge part 55*a* can have a shape of teardrops or elliptical, and can be attached eccentrically to axial part 55*b*. Discharge thereby occurs stably on the surface of on the dielectric substance 57 between the inner side of tip part 51*a* and the sharp head portion of discharge part 55.

Second Embodiment

Ignition Device of an Internal Combustion Engine

Figure 8:
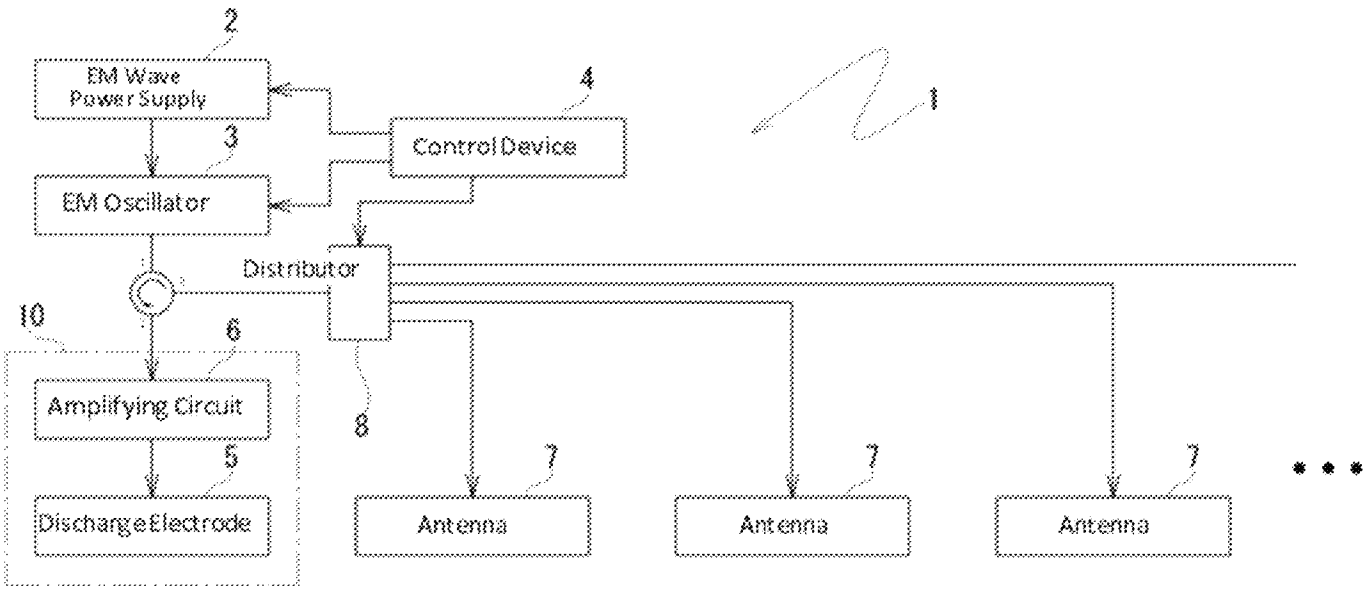
FIG. 8 is a block diagram of another ignition device of the internal combustion engine according to the second embodiment.
Figure 9A:
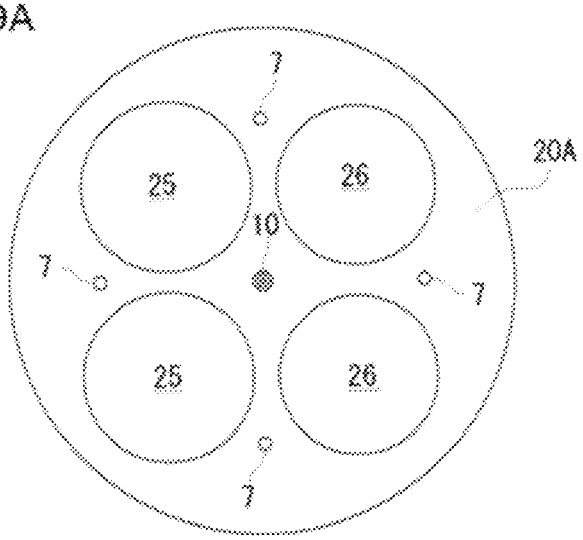
FIGS. 9A and 9B are a plan view of the cylinder head of the internal combustion engine of the second embodiment viewing from the combustion chamber side.

The second embodiment relates to an ignition device of internal combustion engine of the present (second) invention. As shown in FIG. 8, ignition device 1 has EM wave power supply 2, EM-wave oscillator 3, amplifying circuit 5, discharge electrode 6, and control device 4, which is similar to the first embodiment. Further, the ignition device 1 has at least one plasma generator 10 formed integrally the amplifying circuit 5 and discharge electrode 6, and has EM-wave radiation antenna 7 that radiate the EM-wave pulse from EM-wave oscillator 3 to the combustion chamber of the internal-combustion engine which bypass the amplifying circuit. This plasma generator 10 generates plasma which will be a seed fire for igniting the air-fuel mixture inside the combustion chamber, and is arranged at the center of ceiling surface 20A of combustion chamber 20, i.e., the surface of cylinder head 22 which exposes to combustion chamber 20, as shown in FIG. 9A. EM wave radiating antenna 7 is arranged in the position parted from the EM-wave plasma generated by the plasma generator, i.e. between the each port formed on ceiling surface 20A and the outer side of cylinder head 22 as shown in FIG. 9A.

Figure 7:
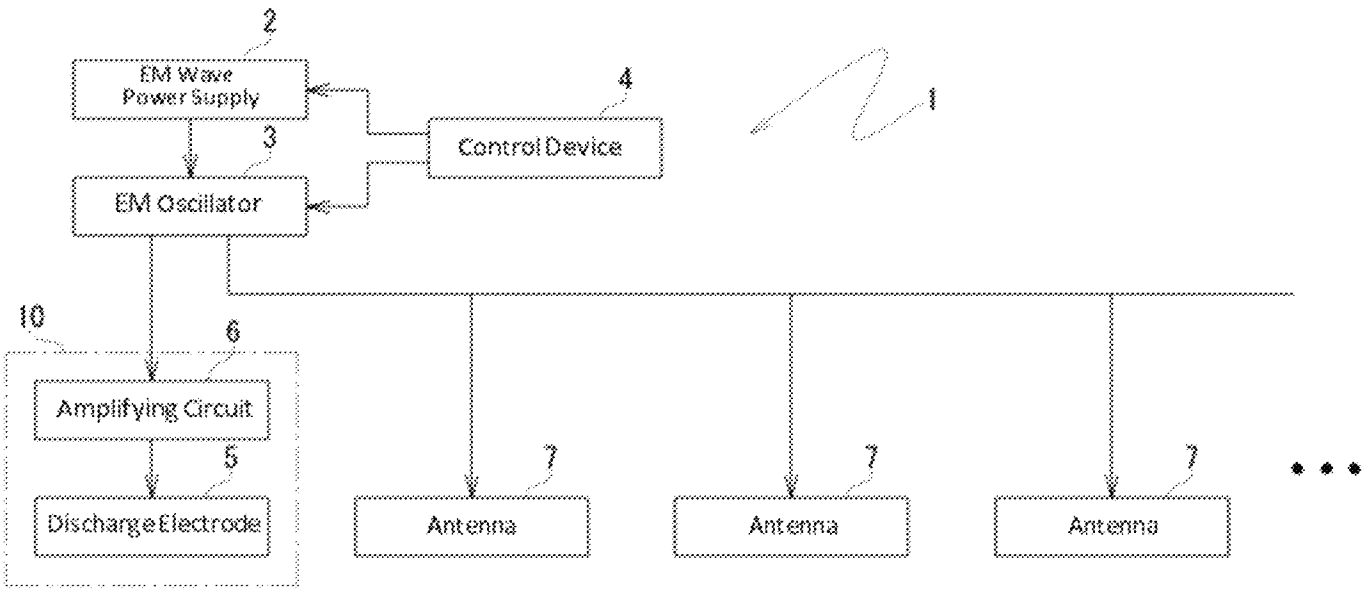
FIG. 7 is a block diagram of the ignition device of the internal combustion engine according to the second embodiment.

In the block diagram illustrated in FIG. 7, EM waves are output simultaneously to multiple EM wave radiating antennas 7. However, other implements are contemplated, for instance, distribution device can be arranged inside EM-wave oscillator 3 and control device 4 can select EM wave radiating antenna 7 that outputs EM-wave pulse.

Plasma generator 10 can be arranged between the intake ports of ceiling surface 20A, and EM wave radiating antenna 7 can be arranged along a swirl flow inside the combustion chamber. Here, the arrangement along the swirl flow means to arrange multiple EM wave radiating antennas 7 along the outer surface of cylinder head, and to control the pulse voltage by control device 4 so as to output EM-wave pulses to EM wave radiating antenna 7 sequentially with different timings so as to follow the swirl flow.

Resonant circuit included in amplifying circuit 5 is configured by first resonance part Re1 and second resonance part Re2 similarly to first embodiment.

The EM waves irradiated from EM wave radiating antenna 7 outputs EM-wave pulses that maintain and enlarge the plasma discharged from plasma generator 10. The pulse voltage outputted to EM wave radiating antenna 7 therefore does not have to transmit the amplifying circuit from EM-wave oscillator 3, and does not have to transmit an amplifying circuit arranged inside the EM-wave oscillator 3.

Advantage of the Second Embodiment

The ignition device of this second embodiment has plasma generator 10 utilizing high voltage and EM wave radiating antenna 7 which irradiates EM waves for maintaining and enlarging the plasma discharged from plasma generator 10. EM waves irradiated from EM wave radiating antenna 7 can be a low voltage, and the electric power an thereby be reduced.

Modification 1 of the Second Embodiment

In the modification 1 of the second embodiment, reflective wave from plasma generator 10 is utilized as an EM wave which will be outputted to EM wave radiating antenna 7 as shown in the block diagram of FIG. 8. In plasma generator 10, the reflective wave increases drastically because the internal impedance matching collapses when high voltage is generated by amplifying circuit and discharge occurs at discharge electrode 6. In this modification, this reflective wave is led to EM wave radiating antenna 7 and the reflective wave is thereby utilized efficiently.

EM-wave oscillator 3, plasma generator 10, and EM wave radiating antenna 7 corresponds to a measure for leading the reflective wave from plasma generator 10 to EM-wave radiation antenna 7. Lines are connected to the connection terminals of circulator so that a progressive wave of EM-wave oscillator 3 transmits to plasma generator 10 and reflective wave from plasma generator 10 transmits to EM wave radiating antenna 7.

In the present embodiment, the three port (terminal) circulator is used as a circulator, while other circulator can be used as well. The three port circulator outputs signal inputted from port 1 to port 2, signal inputted from port 2, and signal inputted from port 3 is outputted to the port 1. In this embodiment, EM-wave oscillator 3 and port 1, plasma generator 10 and port 2, EM wave radiating antenna 7 and port 3 are connected each other. When there are multiple EM wave radiating antennas 7, port 3 is connected to an input terminal of distribution device 8, and EM wave radiating antennas 7 are connected to the multiple output terminals of distribution device 8. The reflective wave from plasma generator 10 is led to the desired EM wave radiating antennas 7 by controlling the distribution device 8 using control device 4.

Plasma generator 10 and EM wave radiating antenna 7 can be constituted integrally without use of distribution device 8.

Figure 9B:
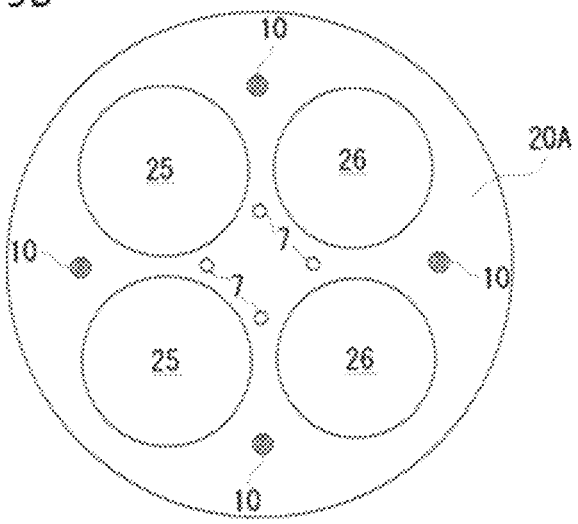
Figure 10:
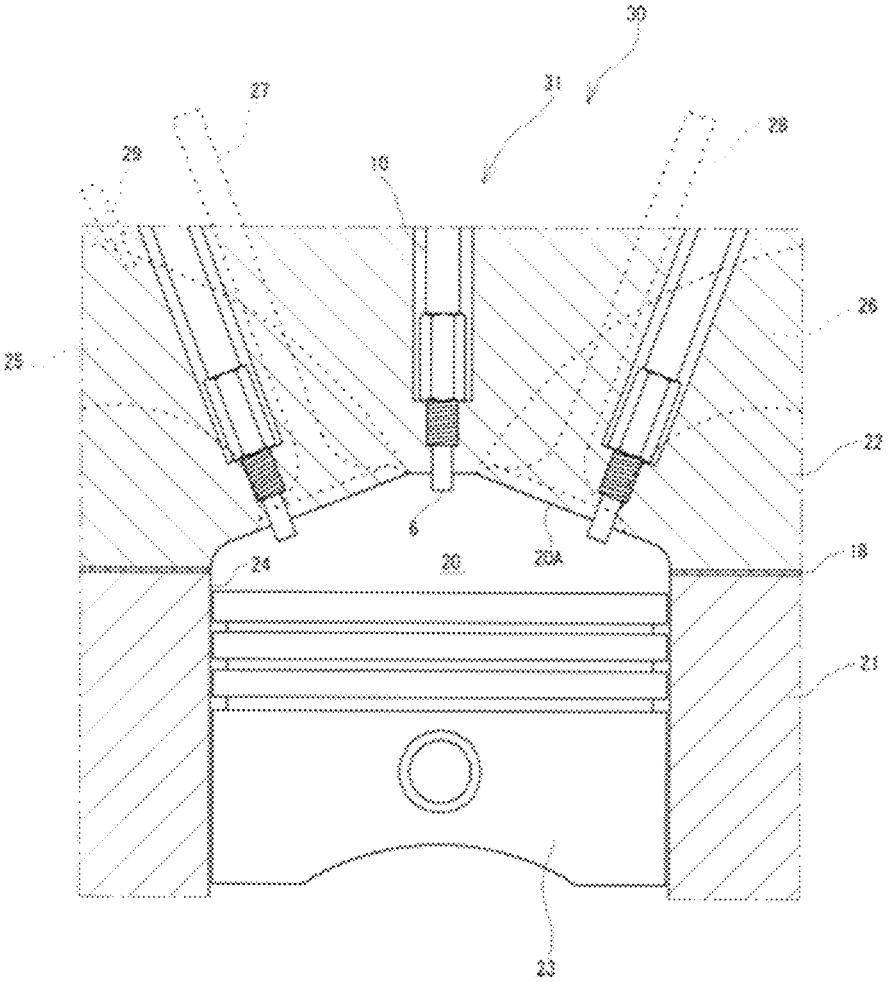
FIG. 10 is a front cross sectional view illustrating the internal combustion engine of the third embodiment.

Multiple pairs of plasma generators 10 and EM wave radiating antenna 7 can be utilized as well. For instance, as shown in FIG. 9B, four pairs of plasma generators 10 and EM wave radiating antenna 7 can be used. In this case, a pair of plasma generators 10 and EM wave radiating antenna 7 can be located between two inlet ports, while plasma generators 10 is located in the outer circumferences and EM wave radiating antenna 7 is located near the central portion. Then remaining three pairs of plasma generators 10 and EM wave radiating antenna 7 can be located similarly in the cylinder head between two exhaust ports and between inlet ports and exhaust ports (two locations). Generally, an ignition plug is located at the center of an internal combustion engine and the flame temperature is relatively low (approximately 800 degrees Celsius) near the center. In this case, the temperature near the outer surface of the cylinder becomes high (approximately 2000 degrees Celsius), which allows a high heat loss due to a heat transmission to the cylinder wall surface. On the contrary, the heat loss can be reduced drastically by arranging plasma generator 10 and EM wave radiating antenna 7 as above because the flame propagates from outer side to inner side in the cylinder.

Third Embodiment

Internal-combustion Engine

The present third embodiment relates to internal combustion engine 30 including an ignition device 1 of the first embodiment. Ignition device 1 generates microwave plasma in combustion chamber 20 as a target space. Internal combustion engine 30 is a reciprocating type gasoline engine, as shown in FIG. 2; however, shall not be limited to this. Internal combustion engine 30 includes internal combustion engine body 31 and the ignition device 1 of the first embodiment.

Internal combustion engine body 31 comprises cylinder block 21, cylinder head 22, and piston 23. Cylinder block 21 has multiple circular cross sectioned cylinders formed therein. Piston 23 is provided inside of each cylinder 24 so as to reciprocate. Piston 23 is connected to crankshaft via connecting rod (not illustrated). Crankshaft is supported rotatable with cylinder block 21. The connecting rod turns a reciprocation of piston 23 into a rotation of the crankshaft when piston 23 reciprocates in the axial direction of cylinder 24 in each cylinder 24.

Cylinder head 22 is provided on cylinder block 21, sandwiching a gasket 18. Cylinder head 22 defines combustion chamber 20 together with cylinder 24 and piston 23.

Multiple ignition devices 1 are provided in each cylinder 24, so that the tip parts of plasma generator 10 in ignition devices 1 are exposed to combustion chamber 20 of internal combustion engine body 31. Tip part of plasma generator 10 functions as discharge electrode 6. In this embodiment, the diameter of plasma generator 10 can be made small compared to conventional spark plugs in automobile engines because the outer diameter can be formed smaller. This allows locating multiple plasma generators 10 in cylinder head 22. Where the space is limited due to the existence of intake and exhaust ports.

Inlet port 25 and exhaust port 26 are formed in cylinder head 22 to cylinder 24. Intake valve 27 for opening and closing inlet ports 25 are formed on inlet port 25. Exhaust valve 28 for opening and closing exhaust port 26 are formed on exhaust port 26.

One fuel injection injector 29 is provided for each cylinder 24. Injector 29 has an injection hole formed in the upper stream side of one of the two inlet ports 25, and sprays fuel to a combustion chamber triggered by the air intake. Injector 29 can be constituted as a direct injection injector which is protruded to combustion chamber 20 between the openings of two inlet ports 25. In this case, injector 29 sprays fuel to different direction from each of multiple jet orifices. As one type of direct injection injector, the injector sprays toward top surface of piston 23. Injectors 29 can be provided on both intake port and combustion chamber (so called "dual injector").

Figure 11A:
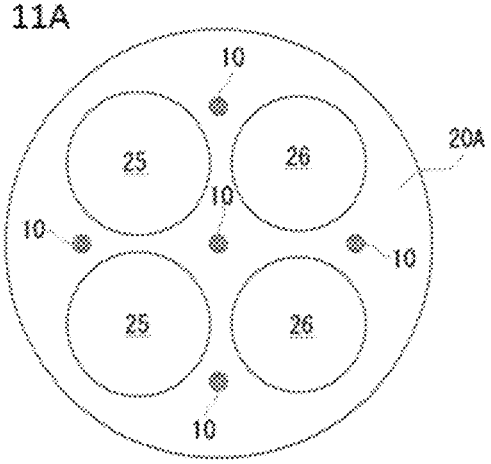
FIGS. 11A and 11B are a plan view of the cylinder head of the internal combustion engine viewing from the combustion chamber side.

Plasma generator 10 of ignition devices 1 are located on the center of ceiling surface 20A of combustion chamber 20, i.e., the surface exposed to combustion chamber 20 in cylinder head 22, between two inlet ports 25, between two exhaust ports 26, and between inlet port 25 and exhaust port 26, as shown in FIG. 11A.

The discharge from each discharge electrode 6 of plasma generator 10 shall be controlled so that each discharge is made on different timings by supplying EM wave to each plasma generator 10 with time difference. This can downsize EM wave power supply 2 which supplies pulsed current to EM wave oscillator 3. Capacity of EM-wave oscillation semiconductor chip inside EM-wave oscillator 3 can be reduced as well. The output of the pulse current can be made smaller in the subsequent stages compared with the pulse current supplied to plasma generator 10 which discharges primarily. This is advantageous when the plasma generator 10 located on the center of ceiling surface 20A is used for the primal discharge (spark discharge) to form a fire seed for igniting the air-fuel mixture, and when the subsequent discharges are used for maintaining and enlarging the plasma generated by the primal discharge. The entire power consumption can therefore be reduced.

Figure 11B:
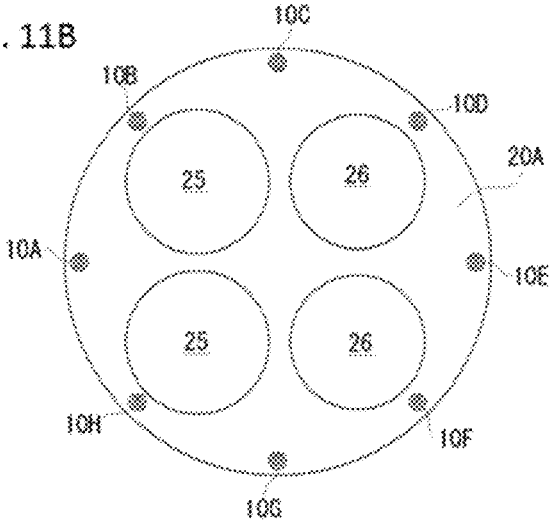

As shown in FIG. 11B, plasma generator 10 of ignition device 1 can be arranged along the outer circumference of ceiling surface 20A of combustion chamber 20. Discharge timing can be controlled so that each plasma generator 10 discharges in order as if a circle or semicircle is drawn. When eight plasma generators (10A to 10H, each of their resonant circuit has different resonance frequency) are arranged as in the figure, plasma generators 10A through 10H discharges one at a time in alphabetical order (as if they are drawing a circle). This can be controlled by changing the oscillation frequency of EM-wave oscillator 3. Further if the plasma generators are discharged in the following order, the discharge pattern can look like a semicircle.

(i) Plasma generator 10A;

(ii) Plasma generators 10B and 10H (simultaneously);

(iii) Plasma generator 10C and 10G (simultaneously);

(iv) Plasma generator 10E;

In this case, resonant frequencies of plasma generators 10B and 10H are set to the same. This is same to plasma generators 10C and 10G, and plasma generators 10D and 10F.

Plasma generators 10A, 10C, 10E, and 10G can be discharged simultaneously, and remainders, i.e., plasma generators 10B, 10D, 10F, and 10H, can be discharged subsequently.

Figure 12A:
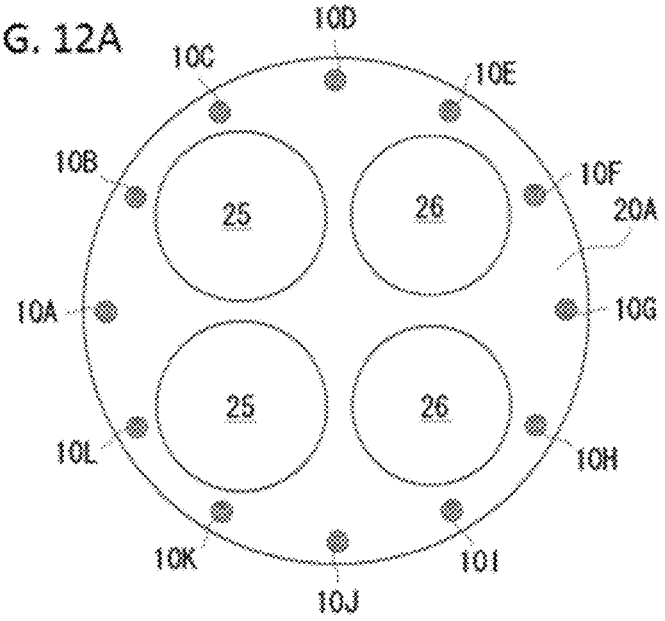
FIGS. 12A and 12B are a plan view of the cylinder head of the internal combustion engine viewing from the combustion chamber side.
Figure 12B:
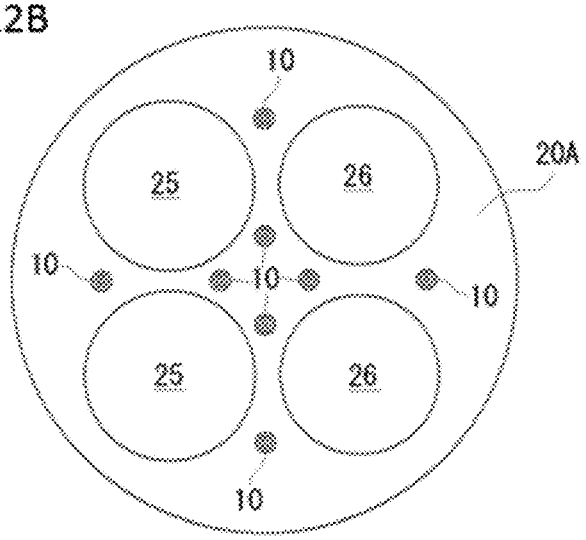

As shown in FIG. 12A, twelve plasma generators 10A to 10L can be arranged along the outer circumference of ceiling surface 20A of combustion chamber 20. Variety of discharging order can be set in this structure, e.g., circular or semicircular (similarly as above). Plasma generators 10 can also be arranged as shown in FIG. 12B. In this case, the pulse current which will be outputted to plasma generator 10 in the center of ceiling surface 20A can be set smaller compared to plasma generator 10 in the outer circumference side.

When multiple plasma generators 10 are arranged in the outer circumference of ceiling surface 20A of combustion chamber 20 as shown in FIGS. 11 and 12, (FIGS. 11B and 12A specifically), the flame propagates from the outer side to inner side of cylinder 24. This reduces the heat quantity transmitted to the cylinder wall surface, and the heat loss is thereby reduced drastically. The heat loss is therefore reduced after the ignition of air-fuel mixture in the internal combustion engine 30 of this embodiment, and the heat generating location is controlled by adjusting the start time of discharge of plasma generator 10. They can be controlled (specifically, discharge output, discharge position, and discharge timing) in the nano-second level by employing semiconductor chips (RF chips) for EM-wave oscillator 3.

Advantage of Third Embodiment

Internal combustion engine of the present thud embodiment employs similar ignition device as the first embodiment. This avoids use of multiple power supplies as in the internal combustion engine equipping conventional plasma generation units including ignition plug using high voltage and microwave radiation antenna, and use of complicated transmission lines. The tip part, i.e., discharge electrode 6 of plasma generator 10, can have smaller diameter compared with the spark plugs of conventional automobile engines, which allows arranging the plurality of those in cylinder head. The flexibility of the arranging locations is high, which allows convenient setups of igniting location (heat generating location) easily.

Homogeneous Charge Compression Ignition (HCCI) system can be employed as the internal combustion engine. HCCI system use self ignition similarly to diesel engines; however, the control is complicated because the ignition timing depends on temperature inside the combustion chamber. Plasma generator 10 of ignition device 1 of the present invention therefore allows a convenient control of the temperature in a combustion chamber by controlling the output of EM waves. The drawback of the HCCI system can thereby be covered.

Fourth Embodiment

Internal Combustion Engine

The fourth embodiment relates to internal combustion engine 30 equipping the ignition device 1 of second embodiment. Ignition device 1 generates microwave plasma in combustion chamber 20 as a target space. Internal combustion engine 30 is a reciprocating type gasoline engine as illustrated in FIG. 2 similarly to the third embodiment; however, other types of engines can be employed. Internal combustion engine 30 has internal combustion engine body and ignition device 1 of the second embodiment.

The structure of internal combustion engine body 31 is similar to the third embodiment. The detailed description is therefore omitted.

Internal combustion engine 30 has at least one plasma generator 10 and one EM wave radiating antenna 7 provided on ceiling surface 20A of combustion chamber 20.

The location of plasma generator 10 and EM wave radiating antenna 7 shall not be limited to a certain location; however, FIG. 9A shows one example.

The plasma generator 10 which is arrange at approximately the center of ceiling surface 20A of combustion chamber 20 (surface of cylinder head 22 exposed to combustion chamber 20) generates plasma which will be a fire seed for igniting air-fuel mixture in combustion chamber 20. EM waves irradiated from EM wave radiating antenna 7 outputs EM-wave pulse for maintaining and enlarging the plasma discharged from plasma generator 10. The pulse voltage which will be outputted to EM wave radiating antenna 7 does not have to be transmitted via amplifying circuit from EM-wave oscillator 3, and does not have to be transmitted through the amplifying circuit arranged inside the EM-wave oscillator 3.

Advantage of Fourth Embodiment

The internal combustion engine of the present fourth embodiment includes plasma generator 10 that discharges plasma for igniting air-fuel mixture using high voltage, and EM wave radiating antenna 7 that irradiates EM waves for maintaining and enlarging the plasma discharged from plasma generator 10. The EM waves irradiated from EM wave radiating antenna 7 requires low voltage only and the entire electric power can thereby be reduced.

Modification 1 of the Fourth Embodiment

The modification 1 of the fourth embodiment employs an ignition device of an internal combustion engine similarly to the modification 1 of the second embodiment. This ignition device was discussed in detail at the modification 1 of the second embodiment; therefore, the detailed description is omitted here. The internal combustion engine of the present modification can reduce the total electric power by equipping such ignition device because the reflective wave from plasma generator 10 can be utilized efficiently.

The internal combustion engine of the present invention can reduce the heat loss drastically because the flame propagates from the outer side to the inner side of cylinder 24, which reduces the heat reaching the cylinder wall surface, by arranging plasma generator 10 and EM wave radiating antenna 7 as above.

Industrial Applicability

As discussed above, the ignition device of the present invention can generate, enlarge, and maintain plasma using EM waves only, which allows the use of only one power supply and complicated transmission lines are not necessary. Plasma generator used for ignition device of the present invention can downsize the diameter of the attachment part to the cylinder head compared with the conventional spark plug. This affords high flexibility of arranging location, and can attach multiple plasma generators conveniently. The plasma can be generated, enlarged, and maintained using EM waves only. The combustion efficiency can thereby be improved because the total power consumption is reduced. The ignition device of the present invention can thereby be used conveniently to the internal combustion engines of the automobile engines.

EXPLANATION OF REFERENCES

1 Ignition device;
2 EM wave power supply;
3 EM-wave oscillator
4 Control device
5 Amplifying circuit
6 Discharge electrode
7 EM wave radiating antenna
8 Distribution device
10 Plasma generator
20 Combustion chamber
20A Ceiling surface
30 Internal combustion engine
51 Case
51 Outside case
51*a* Tip part
52 Input unit
53 Center electrode
54 Electrode
55 Center electrode
55*a* Discharge part
55*b* Axial part
57 Dielectric substance
59 Insulator

The invention claimed is:

1. An ignition device of an internal combustion engine comprising:

an EM wave oscillator that oscillates EM waves;

a control device that controls the EM wave oscillator; and a plurality of plasma generators, each plasma generator including an input part center electrode connected to the EM wave oscillator, an insulator, and a discharge electrode, which are integrally provided in each plasma generator in such manner that forms an amplifying circuit including a resonant circuit in which a capacity coupling is performed between the input part center electrode and a connection part electrode having a bottom portion, the input part center electrode being inserted into the connection part electrode so as to generate high voltage by the amplifying circuit from the EM waves inputted via the input part center electrode and discharge from the discharge electrode the high voltage generated by the amplifying circuit, wherein the amplifying circuit and the discharge electrode are formed integrally together, and wherein the plurality of the plasma generators are installed such that each discharge electrode is exposed to the combustion chamber of the internal combustion engine.

2. The ignition device of claim 1, wherein the plasma generators are installed on the combustion chamber ceiling, respectively at the center of the ceiling, between the inlet ports, between the outlet ports, and between the inlet and outlet ports.

3. The ignition device of claim 1, wherein the plasma generators are installed along the outer circumference of the combustion chamber ceiling.

4. The ignition device as claimed in claim 1, wherein the control device controls so that the EM waves are supplied to each plasma generators in a different time.

5. The ignition device as claimed in claim 4, wherein the control device controls the oscillation of the EM wave oscillator so that the discharge from each discharge electrodes depicts a circle or a semicircle.

6. The ignition device as claimed in claim 1, wherein a resonant circuit of the plurality of the plasma generator is configured such that each generator resonates in different frequency characteristics; and the controller controls the oscillation of the EM wave oscillator by specifying the resonance frequency for each resonant circuits.

7. An ignition device of an internal combustion engine comprising:

an EM wave oscillator that oscillates EM waves;

a control device that controls the EM wave oscillator;

a plasma generator including an amplifying circuit capacity coupled with the EM wave oscillator and a discharge electrode discharging high voltage generated by the amplifying circuit, wherein the amplifying circuit and the discharge electrode are formed integrally together, and an EM wave radiation antenna that radiates EM waves assisting an EM wave plasma generated by the plasma generator; wherein the plasma generator is installed such that the discharge electrode is exposed to the combustion chamber; and at least one EM wave radiation antenna is installed in the position so that the EM wave plasma generated by the plasma generator moves apart.

8. The ignition device of claim 7, wherein the EM waves are supplied to the EM wave radiation antenna using a reflection wave from the plasma generator.

9. The ignition device of claim 8, wherein the EM wave oscillator, the plasma generator, and the EM wave radiation antenna are connected to connection terminals of a circulator such that a progressive wave from the EM wave oscillator flows to the plasma generator and a reflection wave from the plasma generator flows to the EM wave radiation antenna.

10. An internal combustion engine comprising:

the ignition device as claimed in claim 1; and an internal combustion engine forming a combustion chamber therein.

* * * * *